US005214440A

United States Patent [19]

Takahashi et al.

[11] Patent Number: 5,214,440

[45] Date of Patent: May 25, 1993

[54] MOTORIZED ANTENNA DEVICE

[75] Inventors: Yoshikazu Takahashi, Kiryu; Yukiteru Hosoya, Sawagun; Akio Konuma, Ohta, all of Japan

[73] Assignee: Mitsuba Electric MFG. Co., Ltd., Kiryu, Japan

[21] Appl. No.: 846,956

[22] Filed: Mar. 6, 1992

[30] Foreign Application Priority Data

Mar. 8, 1991 [JP] Japan ..... 3-020872[U]

[51] Int. Cl.[5] ..... H01Q 1/10

[52] U.S. Cl. ..... 343/903; 343/715

[58] Field of Search ..... 343/900, 901, 903, 711, 343/712, 713, 714, 715

[56] References Cited

U.S. PATENT DOCUMENTS 4,209,792 6/1980 Corolus et al. ..... 343/903
4,717,923 1/1988 Kimura ..... 343/903
4,864,322 9/1989 Yamamoto et al. ..... 343/903
4,875,053 10/1989 Harada ..... 343/900

FOREIGN PATENT DOCUMENTS 0150302 9/1983 Japan ..... 343/903

*Primary Examiner*—Michael C. Wimer
*Assistant Examiner*—Tan Ho
*Attorney, Agent, or Firm*—Oliff & Berridge

[57] ABSTRACT

A motor is controlled so that it is not driven to further extend an antenna, even when a worm wheel receives a load from a drive cord and rotates to retract the antenna when the antenna is extended to its maximum length. The rotatable worm wheel for extending or contracting the drive cord is connected to a cam forming a motor operation controlling mechanism in which electricity is intermittently passed to the motor on the basis of the amount of rotation of the worm wheel. The cam can rotate through an angle of play Θ provided in the worm wheel to prevent the motor from being driven and the antenna from being extended further.

14 Claims, 5 Drawing Sheets

MOTORIZED ANTENNA DEVICE

BACKGROUND OF THE INVENTION

1. Field of the Invention

The present invention relates to a motorized antenna device for use in vehicles, such as buses, trucks and privately-owned automobiles.

2. Description of the Related Art

In general, some vehicles are equipped with motorized antenna devices with antenna poles which are extended or retracted by driving motors. In such an antenna device, usually, a worm gear on a motor output shaft is engaged with a worm wheel, and a drive cord is let out or wound up in unison with the rotation of the worm wheel so as to extend or retract an antenna pole.

However, in this type of antenna device, because of the precision at which components thereof are processed and incorporated, the length of a drive cord to be let out to extend the antenna pole to its maximum length varies slightly from one antenna device to another. From a practical point of view, it is impossible to adjust the length of the drive cord to be let out on the basis of such variations. The length of the drive cord is made slightly longer than a length actually required to extend the antenna pole. The antenna pole is not loose when it is extended to its maximum length. In such an arrangement, however, when the antenna pole is extended to its maximum length, the drive cord extending the pole is forcibly bent or deflected inside the antenna pole. Such bending or deflection may act as a load which causes the worm wheel to wind up the drive cord.

The length of the drive cord to be let out, that is, the operation of the motor is controlled by the amount of rotation of the worm wheel. The structure of a conventional motor operation controlling mechanism is such that a Geneva gear intermittently engages a cam which rotates together with the worm wheel, causing the Geneva gear to rotate slowly. A relay plate on the Geneva gear is brought into or out of contact with a contact plate as the Geneva gear rotates intermittently so that electricity can pass intermittently to the motor. In such a mechanism, the worm wheel may receive a load from the drive cord stretching the antenna pole and rotating to retract the antenna pole. If such an operation occurs, it is possible for the cam to rotate together with the worm wheel, thus rotating the Geneva gear. Because of such rotation, the relay plate again comes into contact with the contact plate so that the motor is driven to further extend the antenna pole. When the above occurs repeatedly, i.e., chattering occurs, the contact wears markedly and generates heat. To avoid such drawbacks, it is possible to increase the torque of the motor to enhance the counter-electromotive force, which is used as a force to stop the worm wheel from rotating unnecessarily. A large motor must be employed to increase the torque. It is, however, difficult to reduce the size and weight of a large motor and still retain the required increased torque. Thus, a large motor cannot be employed.

SUMMARY OF THE INVENTION

The object of the present invention is to provide a motorized antenna device capable of solving the above discussed problems.

This invention provides a motorized antenna device in which a drive cord is extended or retracted by a rotative operation of a worm wheel based on a motor operation, the device comprising: a mechanism for controlling the motor operation in which mechanism electricity is intermittently passed to a motor on the basis of the amount of the rotation of the worm wheel so that an antenna pole is extended to its maximum length or retracted to its minimum length, the mechanism including a cam rotatable after the worm wheel has started rotating, an insulating Geneva gear which intermittently engages a cam tooth formed on the cam, a relay plate secured to a wheel surface of the Geneva gear, and a contact plate coming in contact with the relay plate and the wheel surface of the Geneva gear, wherein the motor operation is performed by bringing the contact plate which is operable with the rotation of the Geneva gear into or out of contact with the relay plate, the cam being connected to the worm wheel to provide a certain amount of play so that the worm wheel is rotated through only predetermined angle with respect to the cam, and wherein when the worm wheel, which has been rotated in one direction so as to extend the antenna pole to its maximum length, is rotated reversely, the cam is not rotated reversely while the worm wheel is rotating reversely through the angle of the play.

Because of such a structure, even when the worm wheel receives a load from the drive cord and is rotated to retract the antenna pole, the cam will not rotate immediately after the worm wheel has started rotating, and the motor is not driven so as to extend the antenna pole.

BRIEF DESCRIPTION OF THE DRAWINGS

The invention will be described in detail with reference to the following figures, in which.

DETAILED DESCRIPTION OF THE PREFERRED EMBODIMENT

Figure 1:
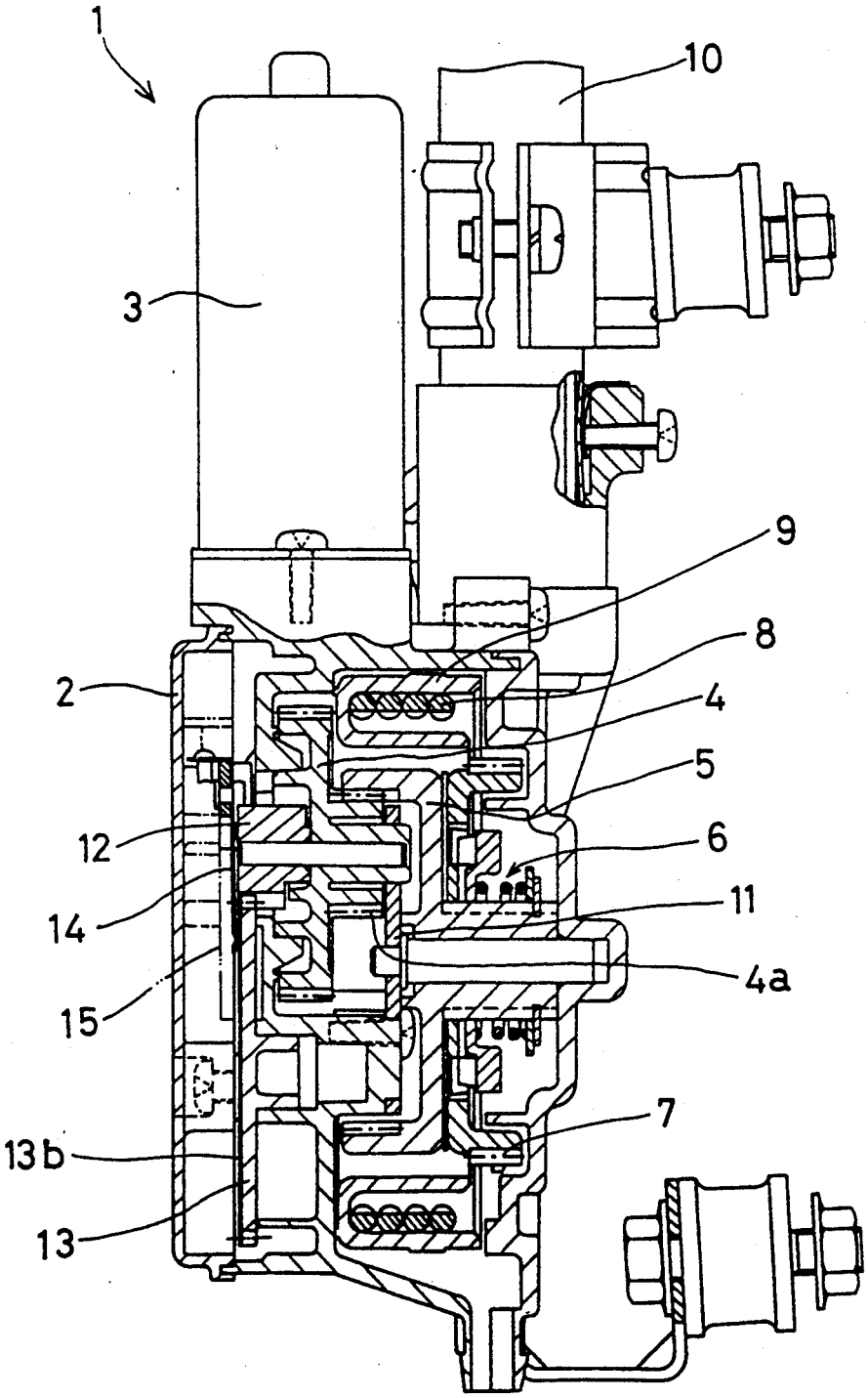
FIG. 1 is a vertical sectional view essentially showing a motorized antenna device.
Figure 2:
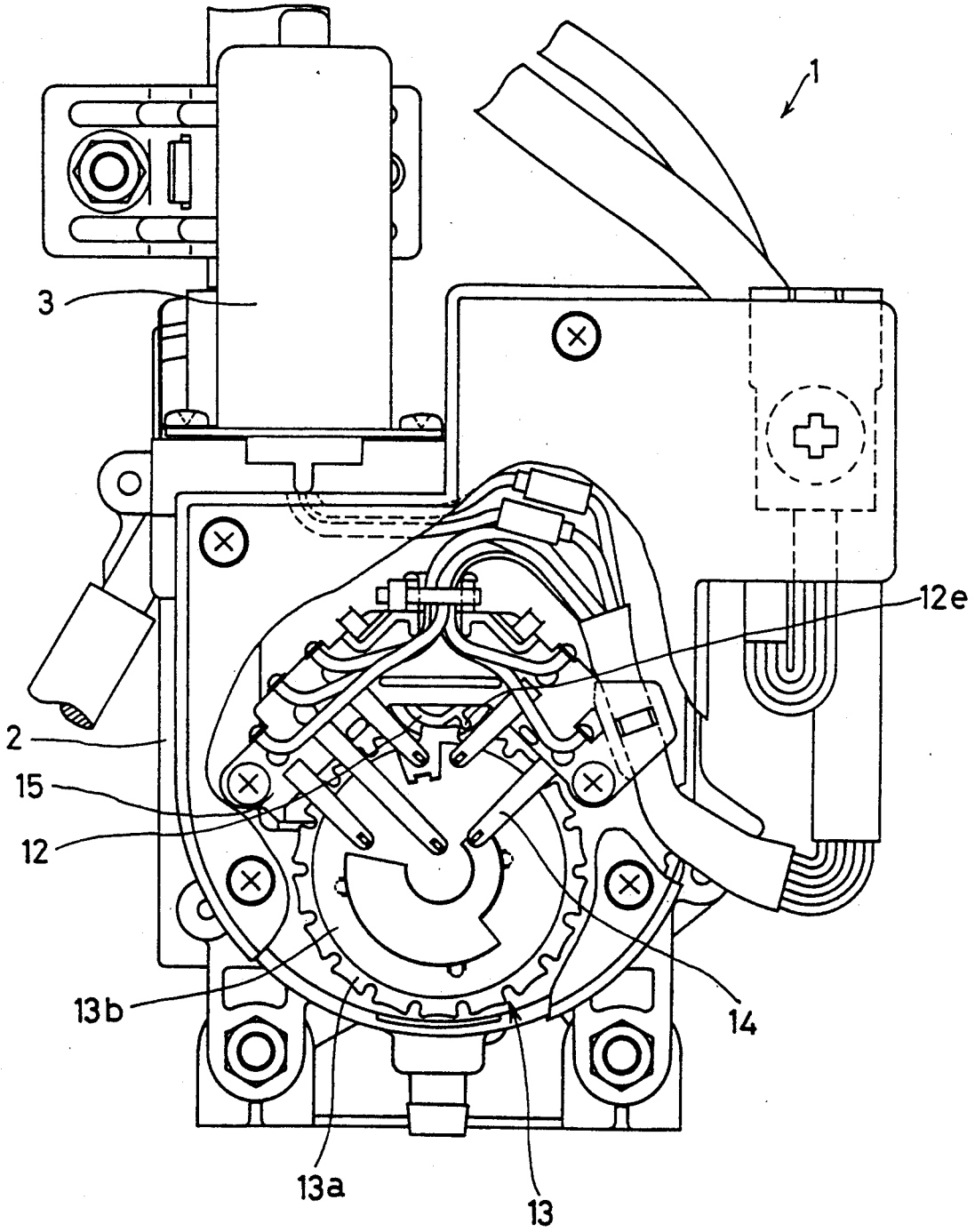
FIG. 2 is a front view of the motorized antenna device, with a portion thereof cut away.

An embodiment of the present invention will be described below with reference to the drawings. In the drawings, numeral 1 denotes a motorized antenna device for use in a vehicle. A worm wheel 4 which inputs the power of a motor 3 through a worm gear (not shown) on a motor shaft, a mid gear 5 which engages a small-diameter gear 4*a* integral with the worm wheel 4, and an operating gear 7 connected to the mid gear 5 through a clutch 6 so as to move in unison with the mid gear 5 are arranged inside the housing 2 of the antenna device 1. A drive cord 8 engaging the operating gear 7, a wind-up drum 9 for winding the drive cord 8, and other components are also arranged inside the housing 2. As the motor 3 is driven, the drive cord 8 is let out by the operating gear 7 into an antenna pole 10, thereby extending it. The drive cord 8 is wound around the wind-up drum 9, thereby retracting the pole 10. Such operation and arrangement are the same as those in the conventional art.

Figure 3A:
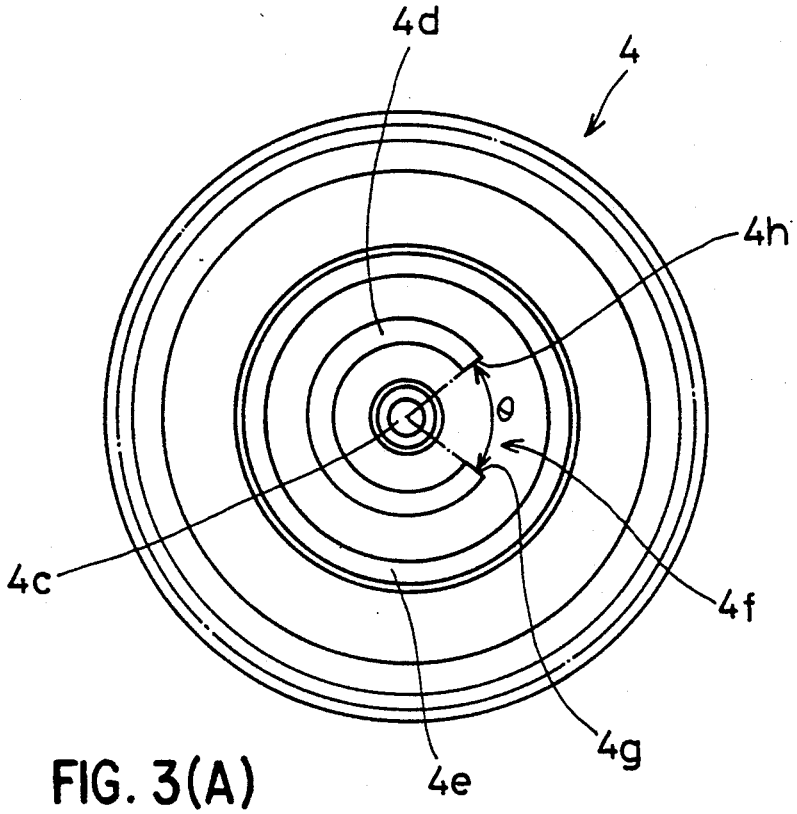
FIG. 3(A) is a front view of a worm wheel.
Figure 3B:
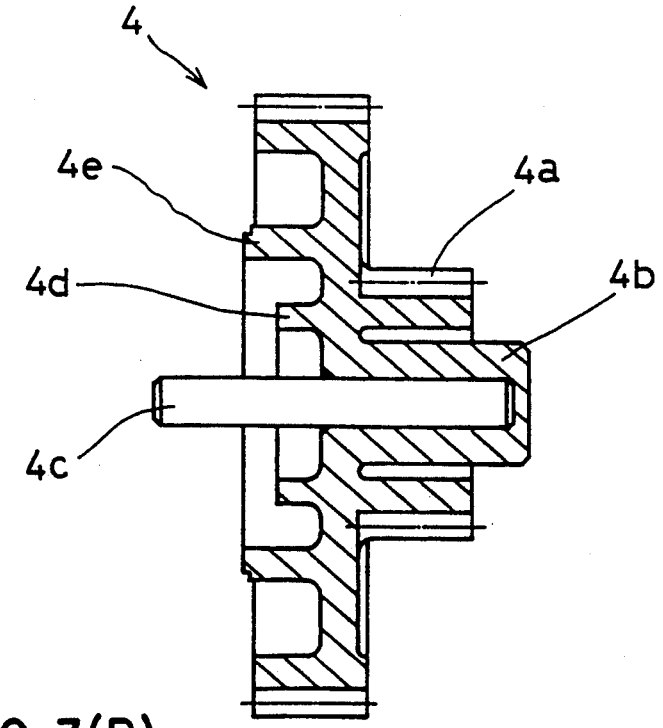
FIG. 3(B) is a vertical sectional view of the worm wheel.

A shaft supporting portion 4b (FIG. 3B) is projected from one surface of the worm wheel 4 so as to face the small-diameter gear 4a. the shaft supporting portion 4b is rotatably supported by a plate 11 secured to the housing 2. A cam shaft 4c is projected from the center of the outer surface of the worm wheel 4 so that the worm wheel 4 and the cam shaft 4c form an integral structure. An inner rib 4d and an outer rib 4e, both of which are concentric with each other, are projected around the cam shaft 4c. A portion of the inner rib 4d is cut away, thus forming an opening 4f (FIG. 3A).

Figure 4A:
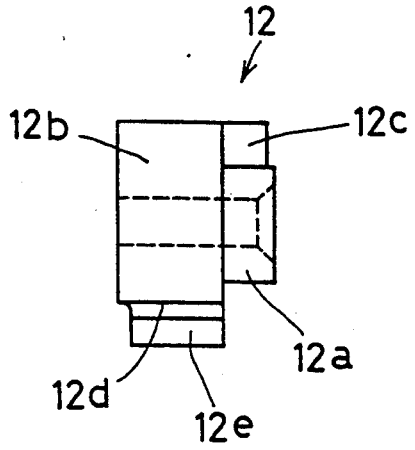
FIG. 4(A) is a side view of the cam.
Figure 4B:
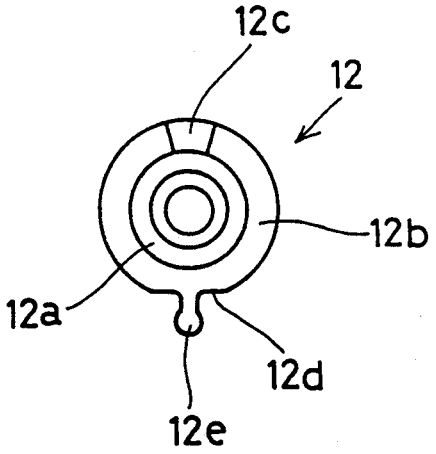
FIG. 4(B) is a plan view of the cam.
Figure 5:
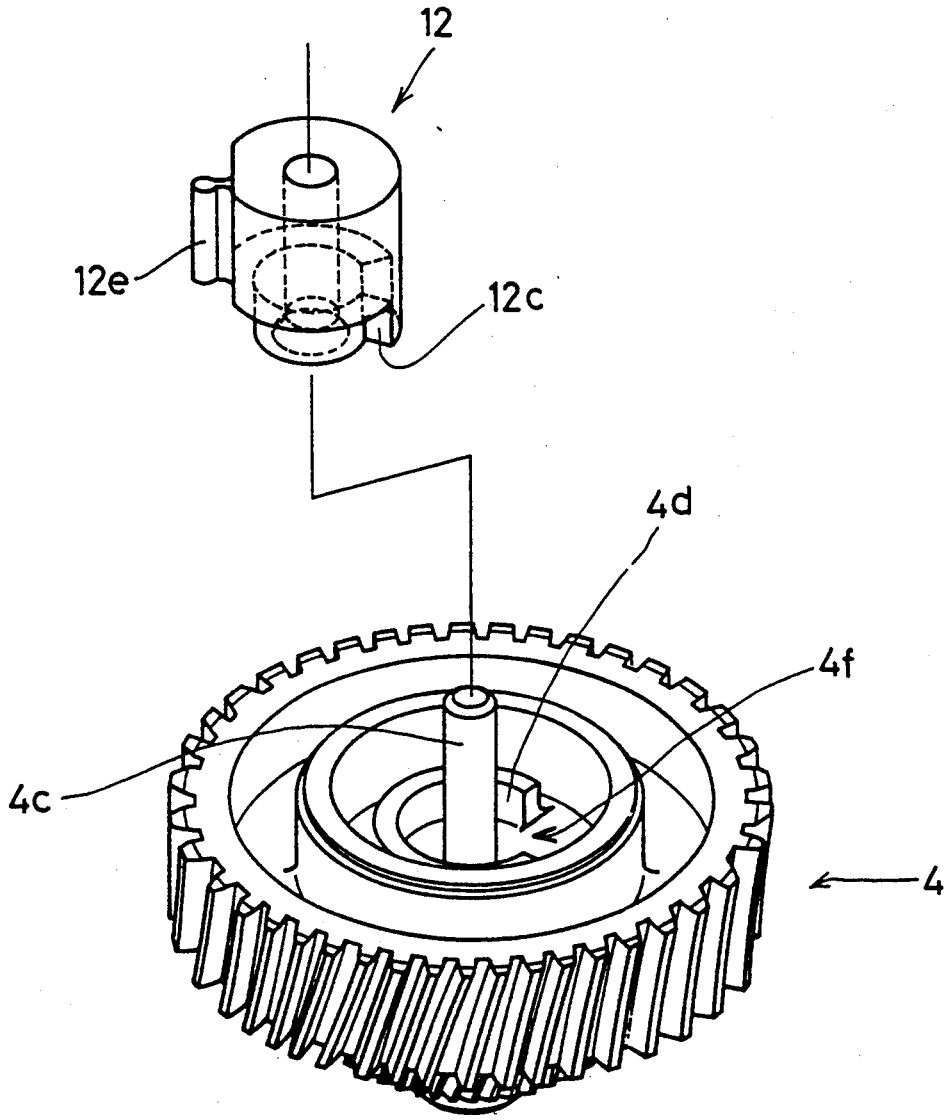
FIG. 5 is an exploded perspective view of the cam and the worm wheel.

Numeral 12 denotes a cam rotatably supported by the cam shaft 4c. A small-diameter boss 12a and a large-diameter boss 12b of the cam 12 are formed in a step-like manner (FIGS. 4A and 4B). The diameter of the small-diameter boss 12a is set so as to mate with the inner rib 4d. A contact piece 12c is formed at a portion of the outer periphery of the small-diameter boss 12a so that it faces outward. The cam 12 is incorporated in the worm wheel 4 while the contact piece 12c is loosely (i.e., freely) fitted into the opening 4f formed in the inner rib 4d. The cam 12 can freely rotate, with respect to the motor-driven worm wheel 4, through an angle $\theta$ until the contact piece 12c comes into contact with either an edge 4g or 4h of the inner rib 4d having the opening 4f. The cam 12 is set in such a manner that when it rotates counterclockwise beyond the angle $\theta$, the edge 4g pushes the contact piece 12c, and when it rotates clockwise beyond the angle $\theta$, the edge 4h pushes the contact piece 12c so that the cam 12 can rotate together with the worm wheel 4 after the worm wheel 4 has started rotating. The outer diameter of the large-diameter boss 12b is substantially equal to that of the inner rib 4d. The chamfer 12d is formed at a portion of the outer periphery of the large-diameter boss 12b and a cam protrusion 12e is projected from the chamfer 12d.

Numeral 13 denotes a Geneva gear which is made of an insulating member and is rotatably supported in the housing 2. A gear tooth 13a which intermittently engages the cam protrusion 12e is formed on the outer peripheral edge of the Geneva gear 13. The Geneva gear 13 intermittently rotates in cooperation with the cam 12 that rotates after the worm wheel 4 has started rotating. A relay plate 13b, made of an electrically-conductive metal, is integrally formed with a surface of the Geneva gear 13. Numeral 14 denotes a contact plate extending from a contact plate holder 15. The operation of the motor 3 is controlled by bringing the contact plate 14 either into or out of contact with the relay plate 13b which is displaced as the Geneva gear 13 rotates. A motor drive controlling mechanism of this invention is thus constructed.

As mentioned above, the antenna pole 10 can be extended or retracted by bringing the contact piece 14 either into or out of contact with the relay plate 13b, which operates based on the rotation of the Geneva gear 13 which intermittently rotates as the worm wheel 4 rotates. For example, when the unillustrated antenna switch is actuated, the motor 3 is driven in a certain direction, thereby rotating the worm wheel 4 in the same direction. Electricity to the motor 3 is cut off approximately when the antenna pole 10 is extended to its maximum length, and the antenna pole 10 is fully extended to its maximum length. When the antenna switch is actuated to retract the extended antenna pole 10, the motor 3 is driven in a reverse direction, thereby rotating the worm wheel 4 in the same reverse direction. The electricity to the motor 3 is cut off approximately when the antenna pole 10 is retracted to its minimum length, and the antenna pole 10 is retracted to its minimum length.

In the thus-constructed embodiment of this invention, as directed above, the motor 3 is driven to rotate the worm wheel 4 which lets out or winds up the drive cord 8 so as to extend or retract the antenna pole 10. The extension and retraction of the antenna pole 10, i.e., the control of the operation of the motor, is effected by bringing the contact plate 14 either into or out of contact with the relay plate 13b, which operates on the basis of the rotation of the worm wheel 4. If the motor 3 is set to stop when the antenna pole 10 is extended to its maximum length while the drive cord 8 is let out a little more than necessary so that the pole is stretched, then the extended pole 10 will not produce looseness.

In this way, when the antenna pole 10 is extended to its maximum length and the drive cord 8 is let out a little more than necessary, the cord 8 stretches the pole and the worm wheel 4 rotates reversely if the load on the cord 8 is great. However, even when the worm wheel 4 is rotated reversely, the cam 12 will not rotate immediately after the worm wheel 4 has started rotating. Since the contact piece 12c is loosely (i.e., freely) fitted into the opening 4f, the cam 12 has an amount of play equal only to the angle $\theta$ (FIG. 3(A)) with respect to the rotation of the worm wheel 4. Therefore, the cam 12 will not be rotated reversely while the worm wheel 4 is rotated reversely through the angle $\theta$, until the edge 4h comes into contact with the contact piece 12c and pushes the cam 12. As a result, even when the worm wheel 4 is rotated reversely because of the load from the drive cord 8, the cam 12 will not rotate reversely immediately after the wheel 4 has started rotating. Also, the Geneva gear 13 will not rotate reversely with respect to the worm wheel 4 when the relay plate 13b comes into or out of contact with the contact plate 14. The motor 3 remains stopped and will not be driven again to extend the antenna pole 10. It is therefore not required to employ a large motor having a high torque so that a damping force produced while the motor is stopped is secured to control the rotation of the worm wheel, as required in the conventional art having an integrally formed worm wheel and cam. A small motor can thus be employed. Even when the worm wheel is rotated because of the load from the drive cord 8, the motor will not be driven again. It is thus possible to avoid the disadvantage wherein a so-called chattering state occurs in which the worm wheel is rotated reversely because of the load from the drive cord, and when chattering occurs repeatedly, the contact wears out early and produces heat. The present antenna device is more reliable than the conventional art even when only a small motor is employed.

In this embodiment, the angle $\theta$ through which the cam 2 can rotate freely with respect to the worm wheel 4 is set at 45°, thereby absorbing the rotation of the worm wheel 4 as the drive cord 8 having a length of approximately 8 mm is wound. Needless to say, a length of 8 mm which is set in this embodiment is sufficient for solving the problem of the drive cord 8 stretching the pole.

The present invention is constricted as described above. The worm wheel is rotated as the motor is driven in a direction, thereby letting out or winding up the drive cord so as to extend or retract the antenna pole. The operation of the motor is controlled by bringing the contact plate either into or out of contact with the relay plate which operates on the basis of the rotation of the worm wheel. When the motor is stopped under such conditions that the antenna pole is extended to its maximum length and the drive cord is let out a little more than necessary so that the pole is stretched, there will be no disadvantage wherein the antenna pole stops just short of its maximum length or produces looseness.

Even if the worm wheel is rotated reversely because of the load from the driven cord stretching the pole, the cam is connected to the worm wheel in such a manner that the cam is not rotated until the worm wheel has rotated through a predetermined angle. Even if the worm wheel is rotated reversely, the cam will not be rotated reversely while the worm wheel rotates through the predetermined angle. As a result, the cam will not be rotated reversely immediately after the worm wheel has started rotating, nor will it rotate the Geneva gear while the antenna pole is extended to its maximum length. The relay plate remains in contact with the contact plate, and the motor remains stopped and will not be driven so as to extend the antenna pole. It is therefore not required to employ a large motor having a high torque so that a damping force produced while the motor is stopped is secured to control the rotation of the worm wheel, as required in the conventional art having an integrally formed worm wheel and cam. A small motor can thus be employed. Even when the worm wheel is rotated because of the load from the drive cord, the motor will not be driven again. Accordingly, it is impossible to avoid the disadvantage wherein a so-called chattering state occurs in which the worm wheel is rotated reversely because of the load from the drive cord, and when chattering occurs repeatedly, the contact wears out early and produces heat. The antenna device is more reliable than the conventional art even when only a small motor is employed.

While the invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A motorized antenna device in which a drive cord is extended and retracted by a rotative operation of a worm wheel based on a motor operation, said device comprising:

a mechanism for controlling the motor operation by controlling passage of mechanism electricity, said mechanism electricity being intermittently passed to a motor on the basis of an amount of the rotation of the worm wheel, said passage of electricity changing a length of an antenna pole from one of a maximum length to a minimum length and the minimum length to the maximum length;

said mechanism including a cam rotatable together with said rotative operation of the worm wheel, an insulating Geneva gear which is intermittently rotated by engaging at least one cam tooth formed on said cam, a relay plate secured to a wheel surface of said Geneva gear, and a contact plate coming in contact with said relay plate and the wheel surface of said Geneva gear;

wherein driving-stopping control for said motor is performed by bringing said contact plate one of into and out of contact with said relay plate when said antenna pole is ended to the maximum length and retracted to the minimum length, wherein a contact piece is provided on said cam, and an opening is formed in said worm wheel, said opening having a predetermined angular length which is larger than said contact piece, wherein said contact piece is fitted freely into said opening, said cam rotates with said worm wheel when said contact piece is pushed by one side of said opening while said contact piece is distant from the other side of said opening and wherein said worm wheel is rotated in the direction of effecting retraction of said drive cord by a restoring force of said drive cord which is extended such that said drive cord is bent when said antenna pole is extended to its maximum length and said motor operation ceases, wherein said cam is not rotated with said worm wheel until said contact piece is pushed by the other side of said opening while said contact piece is distant form the one side of said opening.

2. The motorized antenna device according to claim 1, wherein a shaft supporting portion extends from a surface of said worm wheel, said shaft supporting portion being rotatably supported by a plate.

3. The motorized antenna device according to claim 2, wherein said device has a housing, said plate being secured to said housing.

4. The motorized antenna device according to claim 1, wherein said worm wheel has an outer surface, a cam shaft projecting from a center of said worm wheel outer surface and concentric inner and outer ribs projecting around said cam shaft.

5. The motorized antenna device according to claim 4, wherein said opening in said worm wheel is provided in said inner rib.

6. The motorized antenna device according to claim 5, wherein said cam shaft rotatably supports said cam.

7. The motorized antenna device according to claim 6, wherein said cam includes a small-diameter boss and a large-diameter boss having a diameter larger than said small-diameter boss.

8. The motorized antenna device according to claim 7, wherein said small-diameter boss has an outer periphery, said contact piece being formed at a portion of said outer periphery, said cam being incorporated in said worm wheel as said contact piece is fitted into said opening, said cam freely rotating through said predetermined angular length with respect to said worm wheel until said contact piece contacts an edge of said opening.

9. The motorized antenna device according to claim 8, wherein said opening edge pushes said contact piece when said cam rotates beyond said predetermined angular-length and said cam and said worm wheel rotate together when said opening edge pushes said contact piece.

10. The motorized antenna device according to claim 9, wherein an outer diameter of said large-diameter boss and a diameter of said inner rib are substantially equal, a chamfer being formed at a portion of an outer periphery of said large-diameter boss, a cam protrusion projecting from said chamfer.

11. The motorized antenna device according to claim 1, wherein said relay plate is made of an electrically-conductive metal.

12. A motorized antenna device including a motor having a drive cord which is extended and retracted to control antenna extension, said device comprising:

a control mechanism for controlling motor operation by controlling passage of mechanism electricity, said control mechanism causing electricity to be intermittently passed to the motor in response to an amount of rotation of a worm wheel, said electricity causing a length of an antenna pole to be changed from one of a maximum length to a minimum length and the minimum length to the maximum length, said control mechanism comprising:

a cam shaft which rotatably supports a cam, said cam shaft projecting from an outer surface of said worm wheel;

concentric inner and outer ribs projecting around said cam shaft, said inner rib having a cut-away formed therein;

a small-diameter boss and a large-diameter boss having a diameter larger than said small-diameter boss, said bosses being provided in said cam, said small-diameter boss having an outer periphery, a contact piece being formed at a portion of said outer periphery;

wherein said cam is incorporated in said worm wheel as said contact piece is fitted into said cut-away, said cam freely rotating through a predetermined angle with respect to said worm wheel until said contact piece contacts an edge of said cut-away, said cut-away pushing said contact piece when said cam rotates beyond said predetermined angle, said cam and said worm wheel rotating together when said cut-away edge pushes said contact piece such that said cam is connected to said worm wheel to enable said worm wheel to be rotated through only said predetermined angle with respect to said cam; and wherein when said worm wheel is rotated in a first direction to effect retraction of said drive cord to an extent such that said antenna pole is extended to its maximum length and said motor operation ceases, said cam is not rotated in a direction reverse that of said first direction until said worm wheel rotates in said reverse direction past said predetermined angle.

13. The motorized antenna device according to claim 12, wherein said control mechanism includes an insulating Geneva gear which intermittently engages at least one cam tooth formed on said cam, a relay plate secured to a wheel surface of said Geneva gear and a contact plate for contacting said relay plate and said wheel surface of said Geneva gear, wherein said motor operation is performed by bringing said contact plate one of into and out of contact with said relay plate.

14. The motorized antenna device according to claim 12, wherein an outer diameter of said large-diameter boss and a diameter of said inner rib are substantially equal, a chamfer being formed at a portion of an outer periphery of said large-diameter boss, a cam protrusion projecting from said chamfer.

* * * * *